US009982686B2

(12) United States Patent
Ramirez Ollervides et al.

(10) Patent No.: US 9,982,686 B2
(45) Date of Patent: May 29, 2018

(54) TURNBUCKLE DAMPENING LINKS

(71) Applicant: General Electric Company, Schenectady, NY (US)

(72) Inventors: Aldo Daniel Ramirez Ollervides, Queretaro (MX); Luis Alejandro De Leon Teran, Queretaro (MX); Timothy Jay VanDemark, Mason, OH (US); Steven Edward Horner, Sr., West Chester, OH (US)

(73) Assignee: General Electric Company, Schenectady, NY (US)

( * ) Notice: Subject to any disclaimer, the term of this patent is extended or adjusted under 35 U.S.C. 154(b) by 392 days.

(21) Appl. No.: 14/932,028

(22) Filed: Nov. 4, 2015

(65) Prior Publication Data

US 2017/0122338 A1 May 4, 2017

(51) Int. Cl.

| | |
|---|---|
| ***F04D 29/56*** | (2006.01) |
| ***F04D 27/02*** | (2006.01) |
| ***F01D 25/06*** | (2006.01) |
| ***F01D 17/14*** | (2006.01) |
| ***F04D 29/66*** | (2006.01) |

(Continued)

(52) U.S. Cl.

CPC ..... *F04D 29/563* (2013.01); *F01D 17/14* (2013.01); *F01D 17/162* (2013.01); *F01D 25/06* (2013.01); *F04D 15/0038* (2013.01); *F04D 27/02* (2013.01); *F04D 29/668* (2013.01)

(58) Field of Classification Search

CPC .. F04D 29/563; F04D 29/668; F04D 15/0038; F04D 27/002; F01D 17/14; F01D 17/16; F01D 17/162; F01D 25/06

See application file for complete search history.

(56) References Cited

U.S. PATENT DOCUMENTS

| | | | | | |
|---|---|---|---|---|---|
| 2,858,062 | A * | 10/1958 | Allen | F01D 17/162 | 138/46 |
| 2,933,235 | A * | 4/1960 | Gerhard | F01D 17/162 | 415/149.4 |
| 3,314,595 | A * | 4/1967 | Burge | F01D 17/162 | 415/160 |
| 3,360,240 | A * | 12/1967 | Williamson | F01D 17/162 | 415/160 |

(Continued)

FOREIGN PATENT DOCUMENTS

FR 2793521 A1 * 11/2000 ..... F01D 17/162

*Primary Examiner* — Woody Lee, Jr.
*Assistant Examiner* — Adam W Brown
(74) *Attorney, Agent, or Firm* — General Electric Company; Brian P. Overbeck

(57) ABSTRACT

An elastomeric dampening link including two or more interconnected dampening bushings mounted around corresponding ones of two or more adjustable length turnbuckles linked to devices and elastomeric dampening link includes at least one bar connecting adjacent ones of the dampening bushings. Clamping bands of clamp may be clamped around each of the dampening bushings. Bar may be in tension between the dampening bushings. Each of the turnbuckles may include a rod disposed in a corresponding one of the dampening bushings and having distal hollow internally threaded first end, first eyelet mounted on the first externally threaded shank adjustably screwed into internally threaded first end. One of the bushings may be substantially solid, have a rectangular slot extending inwardly from an annular surface of bushing, and the rod may have six sided surface with two opposite sides slidingly engaging and fitting snugly in the slot. Turnbuckles and links may be used to actuate variable stator vanes.

20 Claims, 9 Drawing Sheets

(51) Int. Cl.
*F01D 17/16* (2006.01)
*F04D 15/00* (2006.01)

(56) References Cited

U.S. PATENT DOCUMENTS 3,487,992 A * 1/1970 Pineda ..... F01D 17/162 415/149.4
3,779,665 A * 12/1973 Tatem, Jr. ..... F01D 17/162 137/601.05
4,050,844 A * 9/1977 Miller ..... F01D 17/162 403/225
4,400,135 A * 8/1983 Thebert ..... F01D 17/162 415/134
4,403,912 A * 9/1983 Pekari ..... F01D 17/162 415/150
4,430,043 A * 2/1984 Knight ..... F04D 29/563 415/149.4
4,755,104 A * 7/1988 Castro ..... F01D 17/162 384/206
4,773,821 A * 9/1988 Gonthier ..... F01D 17/162 415/150
4,890,977 A * 1/1990 Tremaine ..... F01D 17/165 415/150
5,281,087 A * 1/1994 Hines ..... F01D 17/162 415/160
5,549,448 A 8/1996 Langston
6,457,937 B1 10/2002 Mashey
6,551,057 B1 * 4/2003 Haaser ..... F01D 17/162 415/119
7,004,723 B2 * 2/2006 Raulin ..... F01D 17/162 415/160
2005/0008489 A1 * 1/2005 Perruchaut ..... F01D 17/16 416/160
2012/0269613 A1 10/2012 Mills et al.

* cited by examiner

TURNBUCKLE DAMPENING LINKS

BACKGROUND OF THE INVENTION

Technical Field

This invention relates to torque shaft assemblies for moving an array of adjustable members to rotate variable stator vanes in a gas turbine engine. More particularly, it relates to torque shaft assemblies with turnbuckles or rods connecting the torque shaft to unison rings used to rotate the variable stator vanes.

Background Information

Some gas turbine engines with variable stator vanes (VSV) include a torque shaft assembly associated with an actuator. Such an assembly enables and coordinates movement of a plurality of stages of stator vanes responsive to controlled, changing engine conditions by way of crank arms connected to a unison ring for varying the angle of the vanes in each stage. A torque shaft is used to actuate the variable stator vane system of the high-pressure compressors on engines such as the General Electric LM2500+ engine. Generally, a torque shaft actuation system is advantageous in providing flexibility in stage to stage (non-linear) VSV scheduling. Examples of gas turbine engines including axial flow compressors having variable stator mechanisms are disclosed in U.S. Pat. Nos. 2,858,062, 2,933,235, and 5,281,087. Examples of torque shaft assemblies for VSVs are disclosed in U.S. Pat. Nos. 4,890,977, 6,457,937, and 6,551,057.

Torque shafts are used to actuate unison rings through adjustable length push rods or turnbuckles. Rod ends of the rods are pivotably connected to clevises mounted on torque shaft. Rolling motion caused by engine vibration may lead to premature wear of the rod ends and clevises.

SUMMARY OF THE INVENTION

A torque shaft assembly for actuating devices on a gas turbine engine, the assembly including two or more adjustable length turnbuckles linked to devices, an elastomeric dampening link including two or more interconnected dampening bushings mounted around corresponding ones of the two or more adjustable length turnbuckles, and the elastomeric dampening link including at least one bar connecting adjacent ones of the dampening bushings.

A clamp with a clamping band may be clamped around each of the dampening bushings. The bar may be in tension between the dampening bushings. The clamping band may be received in an annular slot or groove in each of the dampening bushings.

At least one of the dampening bushings may be circumscribed about a bushing centerline, be substantially solid, and have a rectangular slot extending radially inwardly from an annular surface of each of the dampening bushings.

Each one of the turnbuckles may include a rod disposed in a corresponding one of the dampening bushings. The rod may have a distal hollow internally threaded first end, a first eyelet mounted on a first externally threaded shank, and the first externally threaded shank adjustably screwed into the internally threaded first end.

At least one of the dampening bushings may be circumscribed about a bushing centerline, be substantially solid, and have a rectangular slot extending radially inwardly from an annular surface of each of the dampening bushings. The rod may have a six sided surface with two opposite sides slidingly engaging and snugly fit in the slot. A clamp with a clamping band may be clamped around each of the dampening bushings.

A variable stator vane actuation apparatus includes a compressor casing surrounding and supporting two or more rows of variable stator vanes, a variable stator vane dampened linkage including two or more unison ring assemblies mounted exterior to the compressor casing and operable for varying the angle of variable stator vanes in corresponding ones of the rows, two or more adjustable length turnbuckles linking corresponding ones of the two or more unison ring assemblies to a torque shaft mounted on the compressor casing, an elastomeric dampening link including two or more interconnected dampening bushings mounted around corresponding ones of the two or more adjustable length turnbuckles, and the elastomeric dampening link including at least one bar connecting adjacent ones of the dampening bushings.

The apparatus may further include first eyelets pivotably connected to first clevises mounted on the torque shaft with first clevis ball joints, the second eyelets pivotably connected to second clevises mounted to unison rings of the two or more unison ring assemblies with second clevis ball joints, and first and second spherical bushings centered and disposed in the first and second eyelets respectively.

The apparatus may further include vane crank arms connecting the variable stator vanes to the unison rings, the second clevises mounted on bridges of the unison rings, each of the turnbuckles including a rod disposed in a corresponding one of the dampening bushings and having distal hollow internally threaded first and second ends, first and second eyelets attached to or mounted on first and second externally threaded shanks respectively, the first and second externally threaded shanks adjustably screwed into the internally threaded first and second ends respectively, The first eyelets pivotably connected to first clevises mounted on the torque shaft with first clevis ball joints.

The second eyelets pivotably connected to second clevises mounted to unison rings of the two or more unison ring assemblies with second clevis ball joints.

The first and second spherical bushings are centered and disposed in the first and second eyelets respectively.

DETAILED DESCRIPTION OF THE INVENTION

Figure 1:
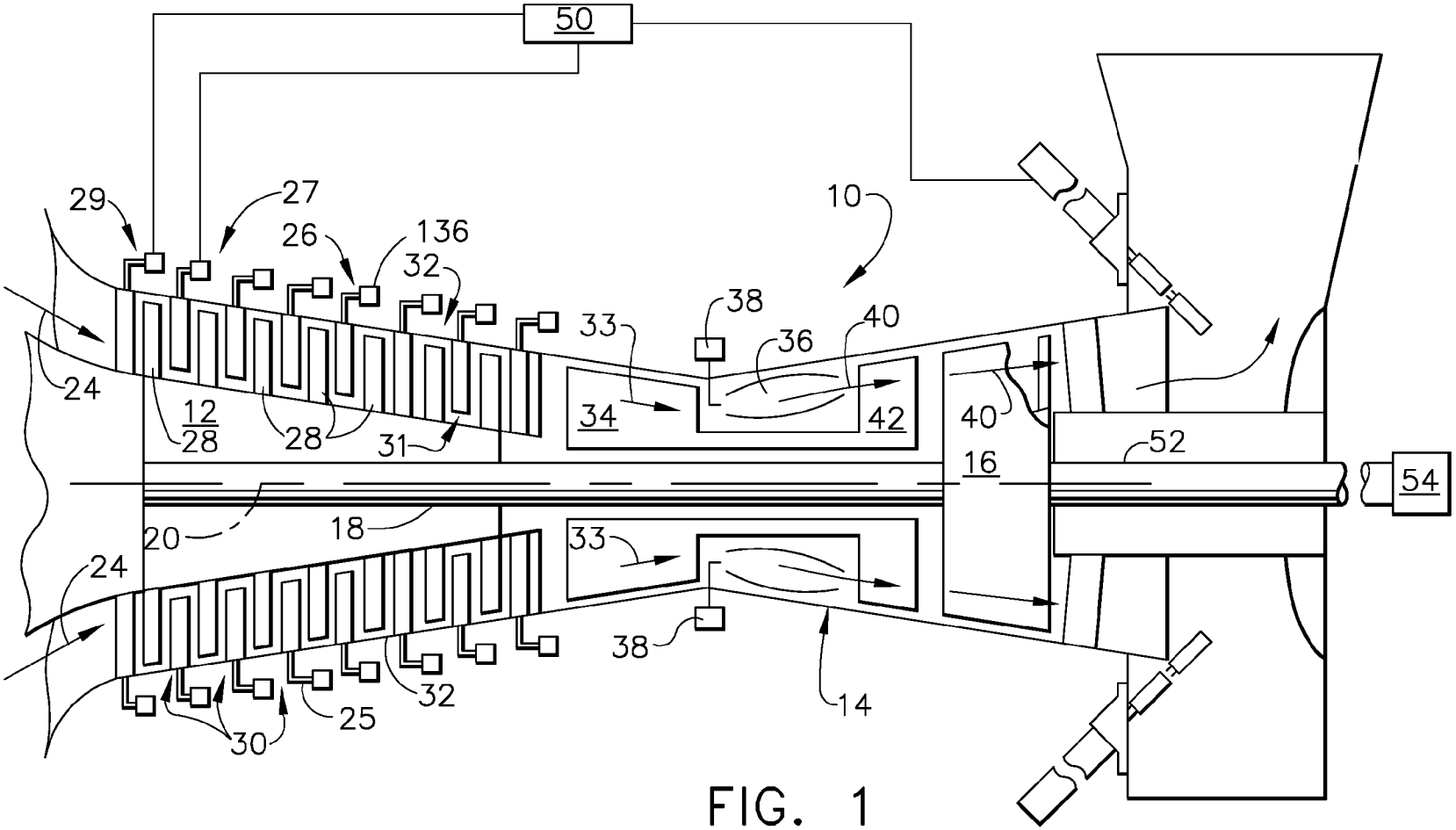
FIG. 1 is a centerline sectional schematic illustration of a gas turbine engine having variable stator vanes activated by a torque shaft and turnbuckles having turnbuckle dampening links illustrated in FIG. 2.

FIG. 1 illustrates an exemplary gas turbine engine 10, such as the General Electric LM2500+ gas turbine engine, including in serial flow relationship a compressor 12, a core engine 14, and a low-pressure or power turbine 16 having a first rotor shaft 18 conventionally joined to the compressor 12 for providing power thereto, all disposed coaxially about a longitudinal centerline axis 20. An output shaft 52 from the power turbine 16 is used to drive an electrical generator 54 or some other device. The compressor 12 compresses an inlet airflow 24 to provide a compressed airflow 33 to the core engine 14 having a conventional high-pressure compressor (HPC) 34 which further compresses at least a portion of the compressed airflow 33 and channels it to a combustor 36. Fuel injection means 38 provides fuel to the combustor 36 wherein it is mixed with the compressed airflow for generating combustion gases 40 which are conventionally channeled to a conventional high-pressure turbine (HPT) 42. The HPT 42 is conventionally joined to the HPC 34 by the first rotor shaft 18.

The compressor 12 includes a variable inlet guide vane 29 followed by a plurality of circumferentially spaced rotor blades 28 and variable stator vanes (VSV) 30 disposed in several rows 31. Illustrated are seven rows of the rotor blades 28 and seven rows 31 of the variable stator vanes 30 surrounded by a compressor casing 32. Stator vanes 30 direct inlet airflow 24 at the desired angle into the rotor blades 28. Variable inlet guide vane 29 and variable stator vanes 30 direct inlet airflow 24 into rotor blades 28 at various angles depending on engine operating conditions to improve compressor stall margin and to improve fuel efficiency of the engine. An engine control 50, such as a mechanical or digital electronic control, is used to control operation of the engine 10 including the varying of the VSVs 30.

Figure 2:
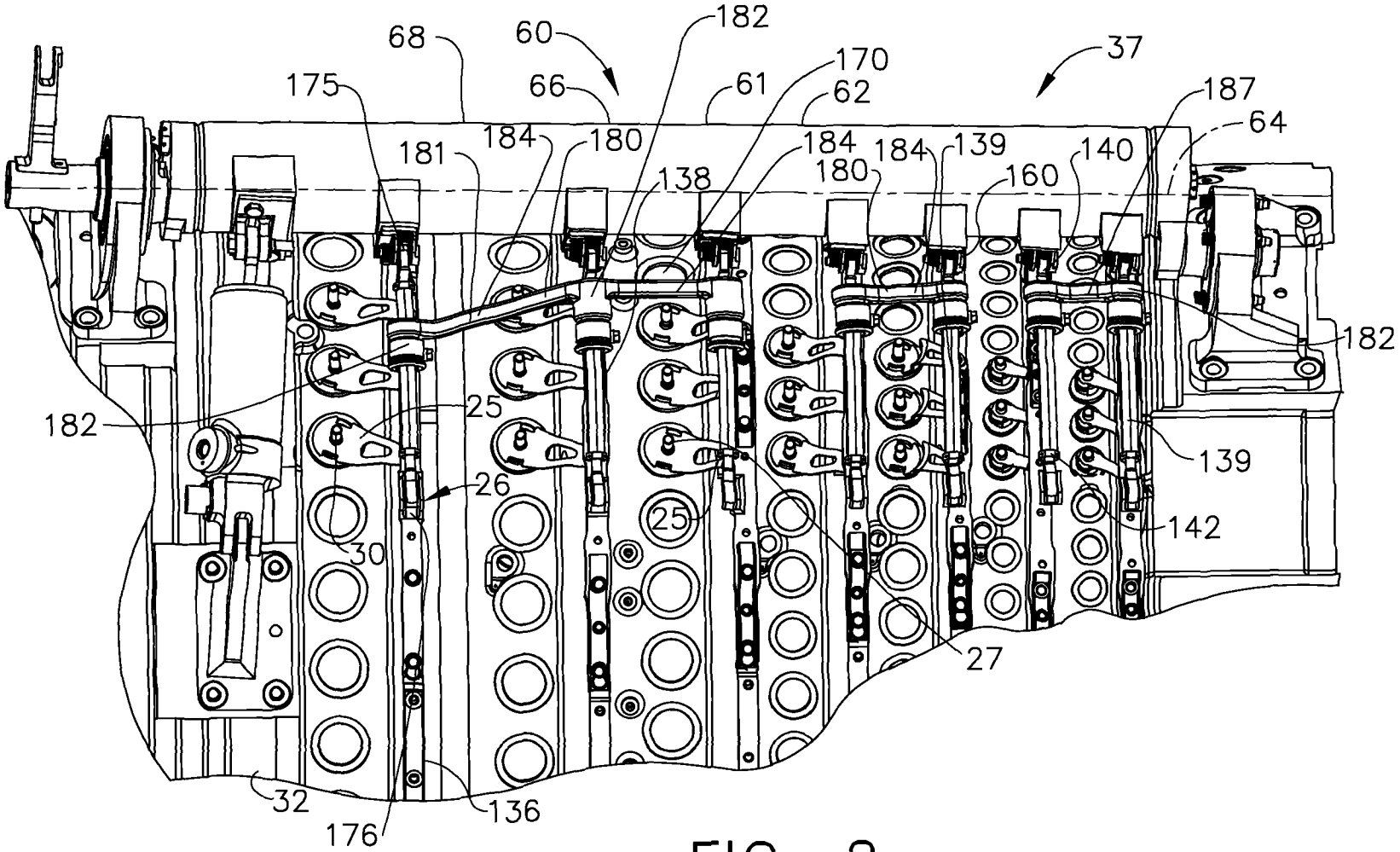
FIG. 2 is a perspective view illustration of a compressor section of the gas turbine engine with the turnbuckle dampening links for turnbuckles connected to the torque shaft for actuating the variable stator vanes illustrated in FIG. 1.

Illustrated in FIG. 2, is a variable stator vane actuation apparatus 37 for varying the angles of the variable stator vanes 30 illustrated in FIG. 1. The variable stator vanes 30 are rotatably mounted to the compressor casing 32 and are rotatably actuated by and connected to vane crank arms 25 connected to unison ring assemblies 26 mounted exterior to the compressor casing 32. The variable stator vane actuation apparatus 37 vary the angles of the VSVs with respect to airflow 24. Variable stator vanes 30 and associated actuation devices in an HPC are well known in the field of gas turbine engines as indicated in the references above. A torque shaft assembly 60 is illustrated on the compressor casing 32 of the compressor of the engine 10. Though only one torque shaft assembly 60 is illustrated, two are typically used, one on each side of the engine or about 180 degrees apart from each other with respect to the longitudinal centerline axis 20. The torque shaft assembly 60 may be generically described as a torque shaft assembly 60 for actuating devices 27 such as the variable stator vanes 30.

Figure 3:
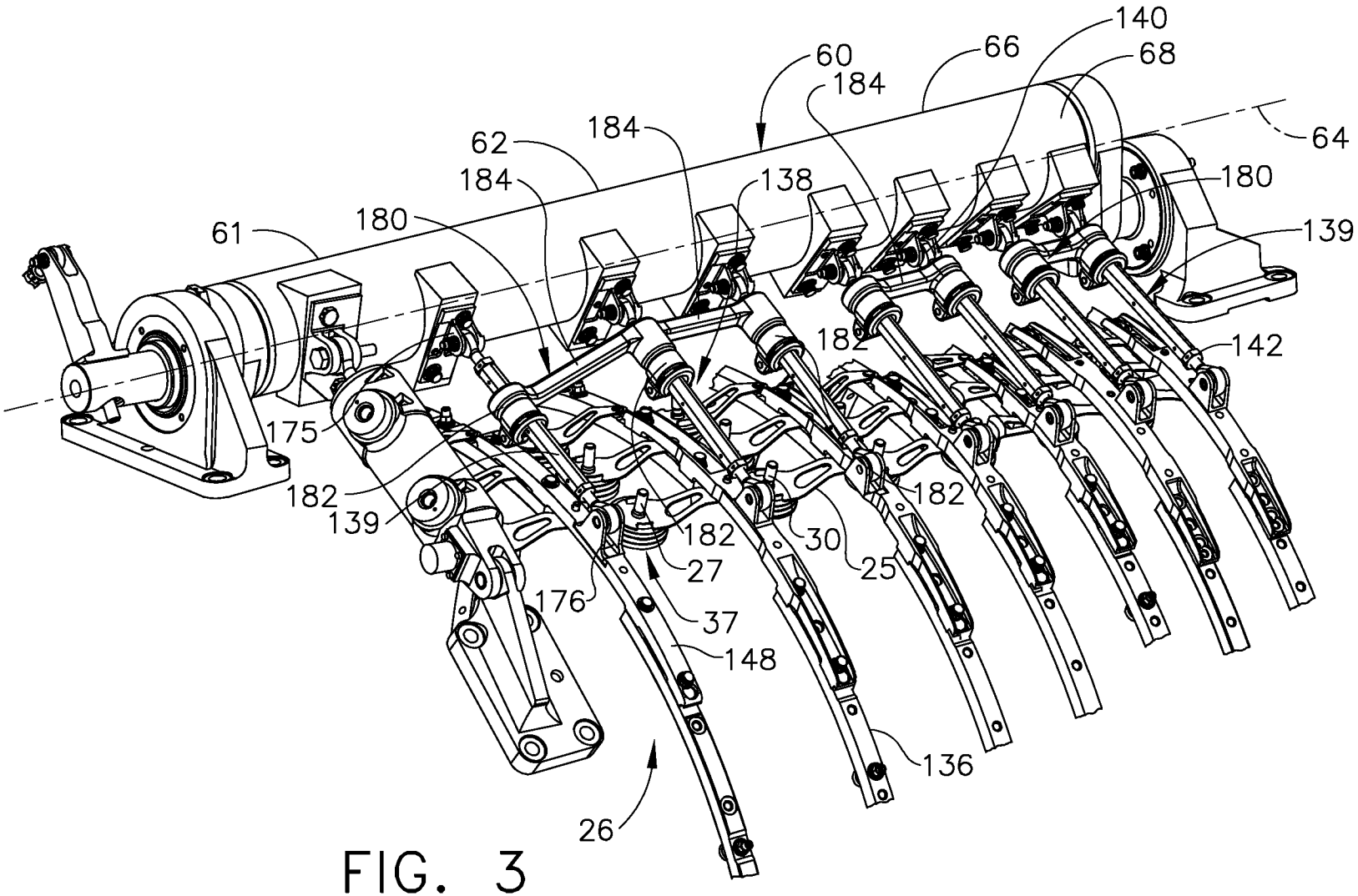
FIG. 3 is a perspective view diagrammatic illustration of the turnbuckle dampening links in a torque shaft assembly illustrated in FIG. 2.

Referring to FIGS. 2 and 3, the torque shaft assembly 60 includes a torque shaft 61 which may be a hollow metal tube 62 as illustrated in the exemplary embodiment disclosed herein. The metal tube includes a substantially continuous tube wall 66 having a tube wall outer surface 68 for maintaining structural integrity. The tube 62 is pivotable about its tube axis 64 enabling the tube 62 to operate as a single crank and pivot about the tube axis 64 and apply torque and supply power to move associated unison rings 136 of the unison ring assemblies 26 through adjustable length turnbuckles 138. Each of the turnbuckles 138 includes a rod 139 having distal hollow internally threaded first (illustrated in FIG. 11) and second ends 140, 142.

Figure 11:
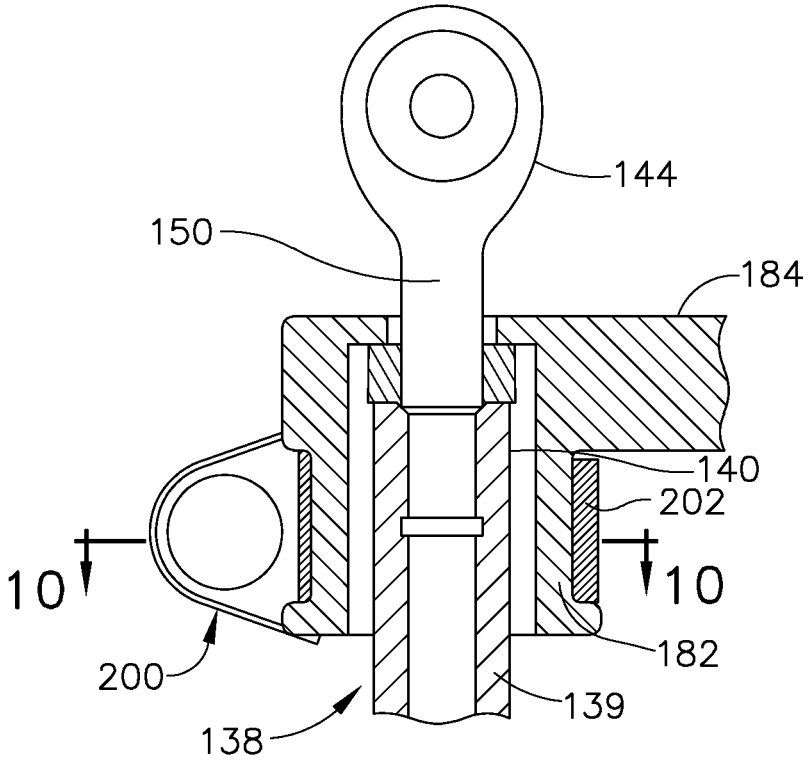
FIG. 11 is cross-sectional view diagrammatic illustration the hose clamp around the dampening bushing of the turnbuckle dampening link illustrated in FIG. 10.

Referring to FIGS. 5-7 and 11, first and second eyelets 144, 146 attached to or mounted on first and second externally threaded shanks 150, 152 respectively are operably used to connect the torque shaft 61 to the unison rings 136 with the rods 139. The first and second externally threaded shanks 150, 152 are adjustably screwed into the internally threaded first and second ends 140, 142 of the rod 139. A more detailed cross-section of the first externally threaded shank 150 adjustably screwed into the internally threaded first end 140 of the rod 139 is illustrated in FIG. 11.

Figure 5:
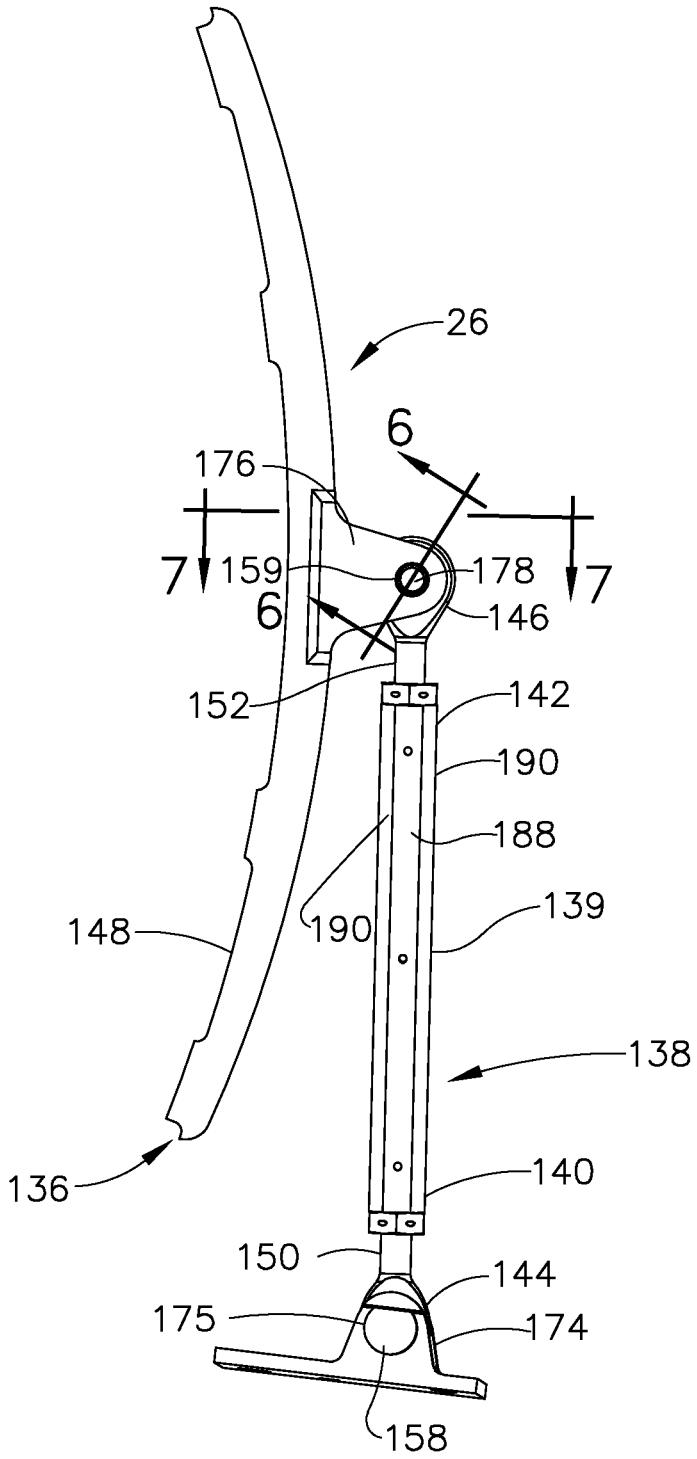
FIG. 5 is an axial perspective view diagrammatic illustration of one of the turnbuckles illustrated in FIG. 2.
Figure 6:
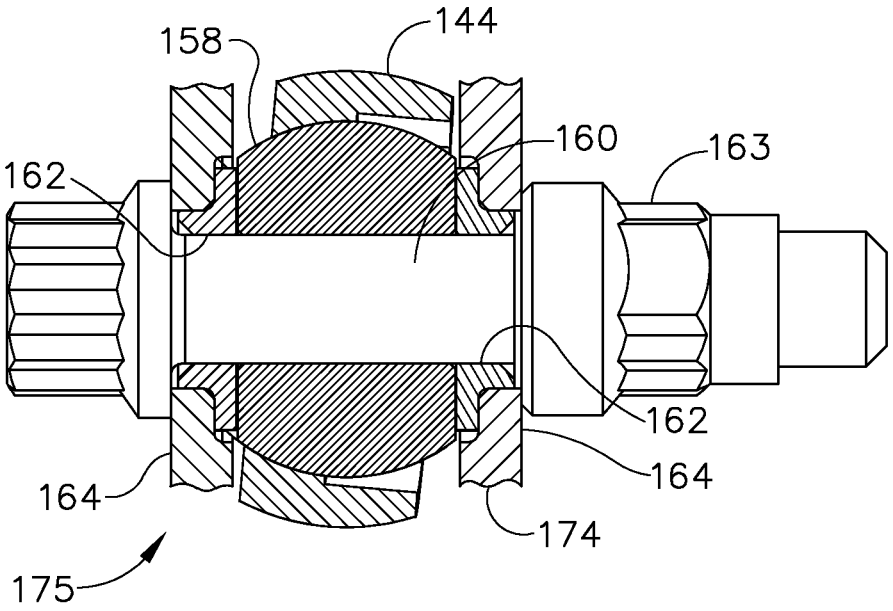
FIG. 6 is a partially sectional and partially perspective view illustration of a clevis joint for the turnbuckle dampening link through 6-6 in FIG. 5.
Figure 7:
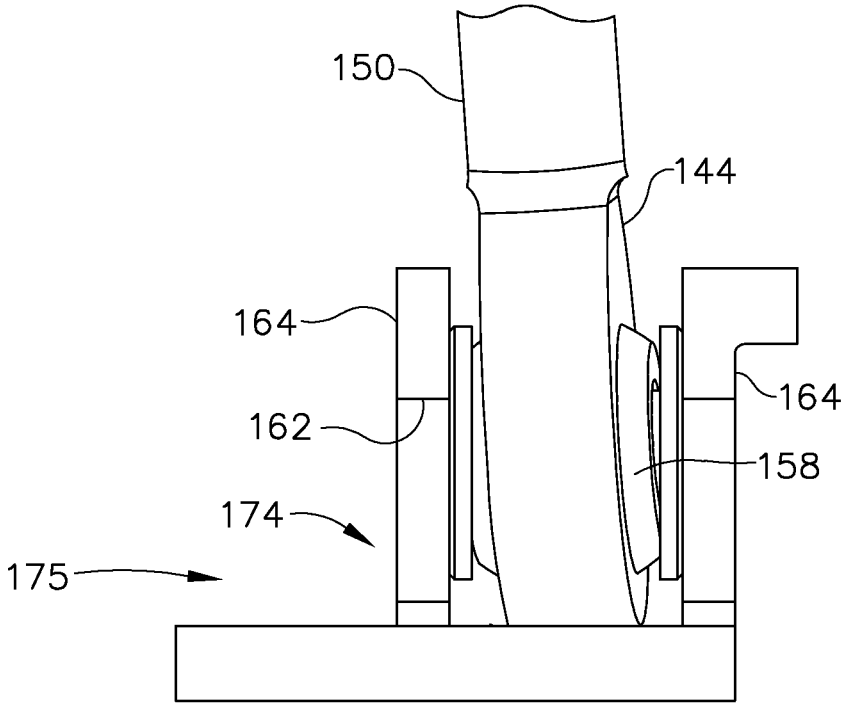
FIG. 7 is a sectional view illustration of the clevis joint through 7-7 in FIG. 5.

Referring more particularly to FIGS. 5-7, the first eyelet 144 is pivotably connected to a first clevis 174 mounted on the outer surface 68 of the torque shaft 61 (illustrated in FIG. 2) with a first clevis ball joint 175. The second eyelet 146 is pivotably connected to a second clevis 176 mounted on a bridge 148 of the unison ring 136 with a second clevis ball joint 178. First and second spherical bushings 158, 159 centered and disposed in the first and second eyelets 144, 146 respectively. The first and second eyelets 144, 146 and the first and second spherical bushings 158, 159 are secured to the first and second clevises 174, 176 by bolts 160 disposed through holes 162 through lugs 164 of the first and second clevises 174, 176. Nuts 163 secure the bolts 160.

Figure 4:
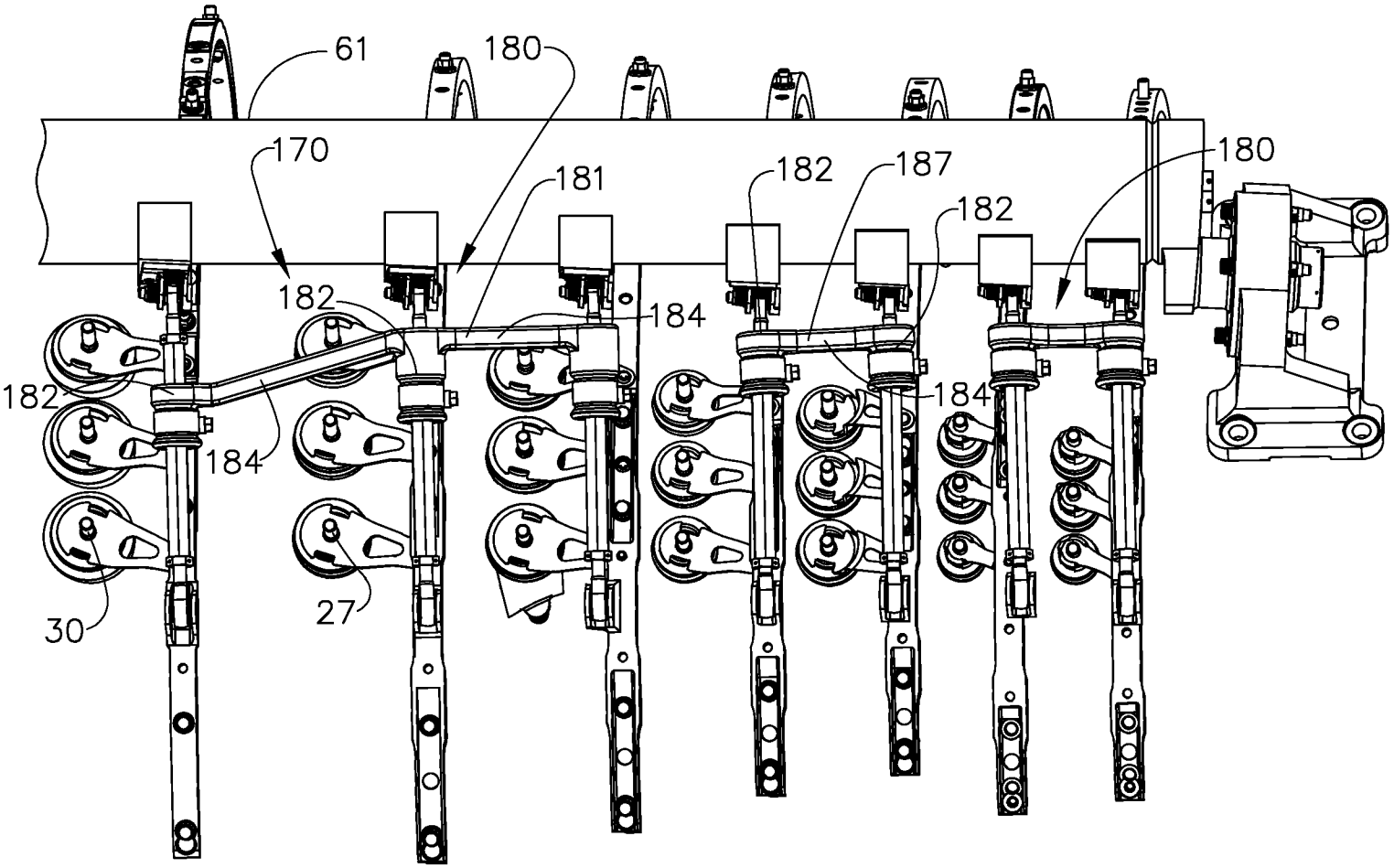
FIG. 4 is a perspective side view diagrammatic illustration of the turnbuckle dampening links in a torque shaft assembly illustrated in FIG. 2.

Referring to FIGS. 2-4, rolling motion of the turnbuckles caused by the engine vibration causes unwanted wear in the first and second eyelets 144, 146 of the turnbuckles 138 and the lugs 164 of the first and second clevises 174, 176. A variable stator vane dampened linkage 170 is provided to minimize and/or prevent the unwanted wear. The dampened linkage 170 includes elastomeric dampening links 180 having interconnected dampening bushings 182 as illustrated in FIGS. 2-4 and 8-9. Adjacent ones of the dampening bushings 182 are connected by a bar 184. The elastomeric dampening link 180 includes lengths L of the adjacent ones of the dampening bushings 182 and the interconnecting bar 184 that allows the elastomeric dampening link 180 to work in tension to prevent rolling motion. Thus, the interconnecting bar 184 is placed in tension between the dampening bushings 182. Clamping, described below, and the tension are designed to prevent rolling. Each elastomeric dampening link 180 includes two or more dampening bushings 182. The elastomeric dampening links 180 may be unitary and monolithic and made of an elastomeric material such as Viton. Viton is a brand of synthetic rubber and fluoropolymer elastomer commonly used in molded or extruded goods. Viton is a registered trademark of DuPont Performance Elastomers L.L.C.

Figures 8, 9:
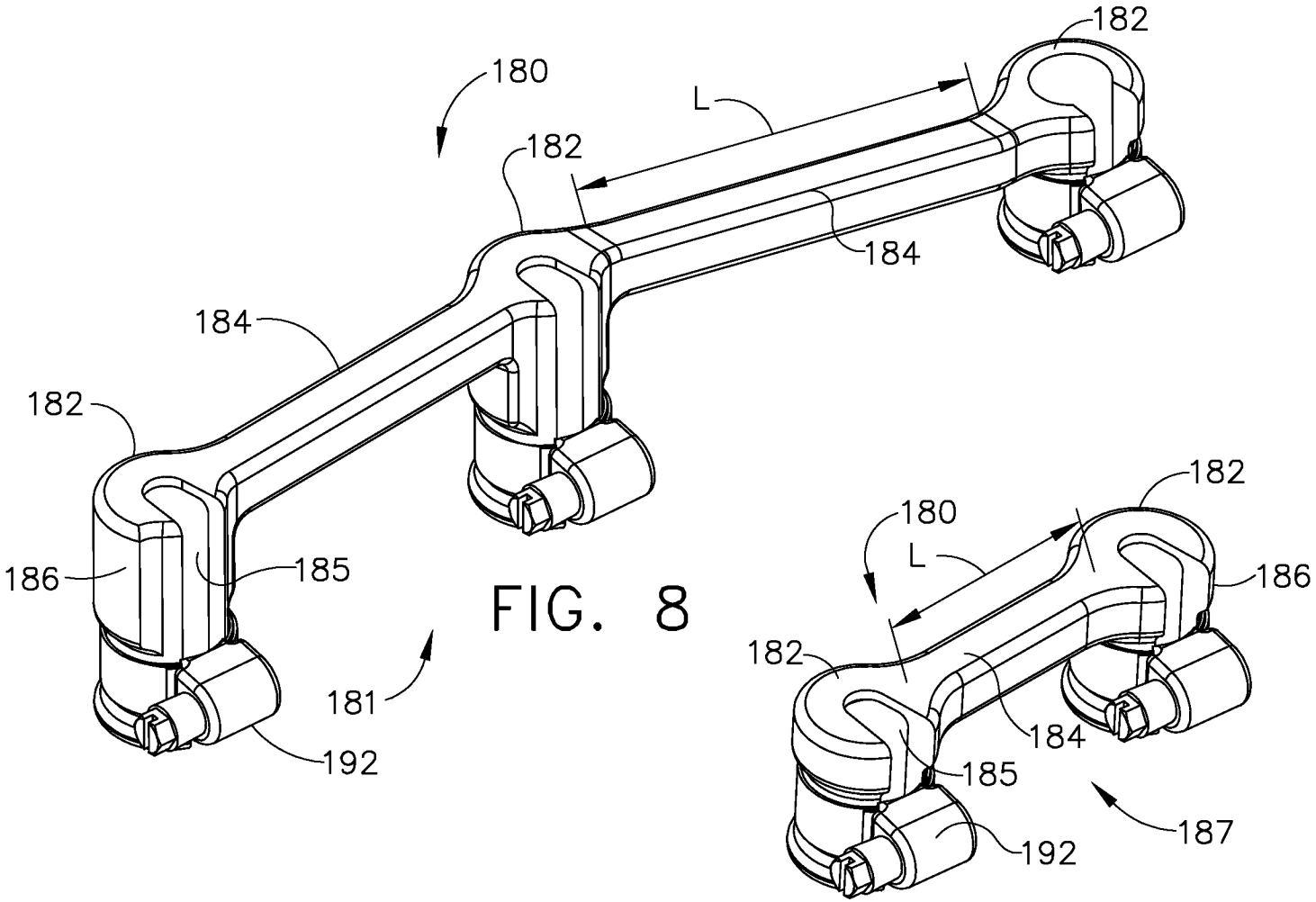
FIG. 8 is a perspective view diagrammatic illustration of a triple turnbuckle dampening link illustrated in FIGS. 2-4.
FIG. 9 is a perspective view diagrammatic illustration of a double turnbuckle dampening link illustrated in FIGS. 2-4.
Figure 10:
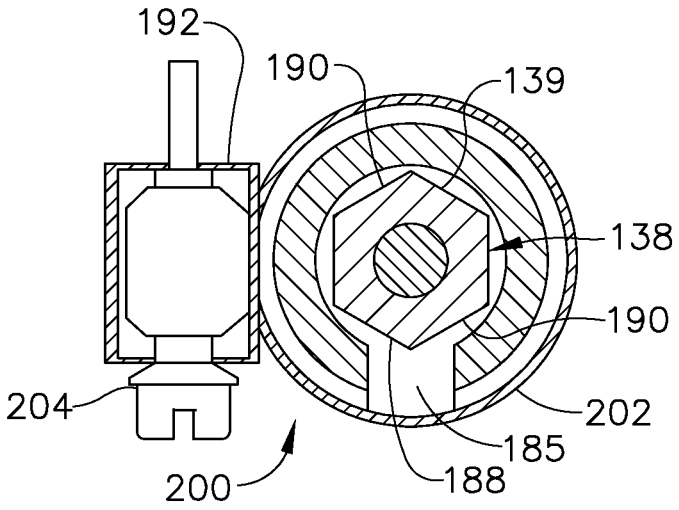
FIG. 10 is cross-sectional view diagrammatic illustration of a hose clamp around a dampening bushing of the turnbuckle dampening link illustrated in FIG. 4.

FIG. 8 illustrates a triple turnbuckle dampening link 181 and FIG. 9 illustrates a double turnbuckle dampening link 187. The triple turnbuckle dampening link 181 includes three adjacent dampening bushings 182 and each two adjacent dampening bushings 182 are connected by a bar 184. The double turnbuckle dampening link 187 includes two adjacent dampening bushings 182 connected by a bar 184.

Figure 12:
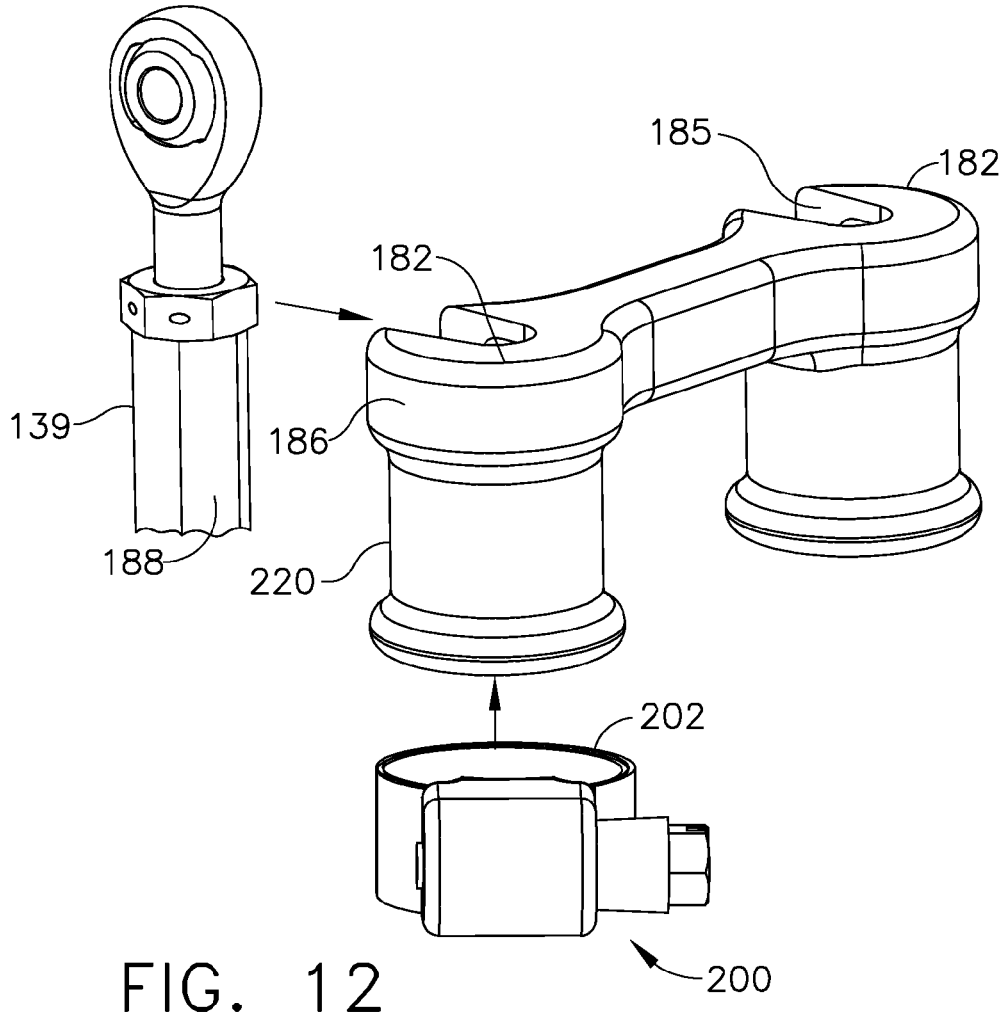
FIG. 12 is an exploded perspective view diagrammatic illustration of the hose clamp around the dampening bushing of the turnbuckle dampening link illustrated in FIG. 11.

Referring to FIGS. 8, 9, and 12, each of the exemplary dampening bushings 182 illustrated herein is cylindrical, circumscribed about a bushing centerline 183. One or more of the bushings 182 may be substantially solid with a rectangular slot 185 extending radially inwardly from an annular surface 186 of the dampening bushing 182. The turnbuckle rod 139 includes a six sided surface 188 with two opposite sides 190 operable to slidingly engage and fit snugly in the slot 185. A clamp 192 is fitted around the dampening bushing 182 to tighten up and secure the dampening bushing 182 around and to the turnbuckle rod 139. Two exemplary clamps are illustrated herein.

Figure 13:
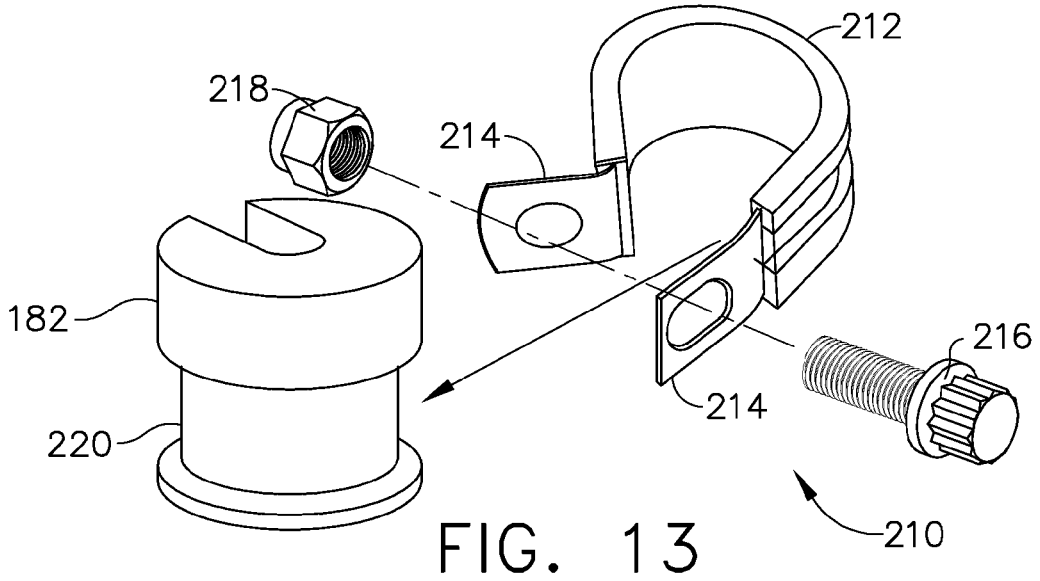
FIG. 13 is an exploded perspective view diagrammatic illustration of a loop clamp around a dampening bushing of the turnbuckle dampening link illustrated in FIG. 4.

FIGS. 8-12 illustrate a hose clamp 200 including an adjustable clamping band 202 fitted around the dampening bushing 182 and a clamp screw 204 for adjusting the width of and tightening the adjustable clamping band 202 around the dampening bushing 182. FIG. 13 illustrates a loop clamp 210 including a fixed width clamping band 212 with looped ends 214 fitted around the dampening bushing 182 and a clamp bolt 216 and clamp nut 218 for tightening the fixed width clamping band 212 around the dampening bushing 182. Illustrated in FIGS. 12 and 13 is an annular slot or groove 220 around the dampening bushing 182 for receiving the adjustable clamping band 202 or the fixed width clamping band 212 respectively. The annular slot or groove 220 helps retain the bands on the dampening bushing 182.

The present invention has been described in connection with specific examples, embodiments, materials, etc. However, it should be understood that they are intended to be representative of, rather than in any way limiting on, its scope. Those skilled in the various arts involved will understand that the invention is capable of variations and modifications without departing from the scope of the appended claims.

What is claimed is:

1. A torque shaft assembly for actuating devices on a gas turbine engine, the assembly comprising:

two or more adjustable length turnbuckles linked to devices, an elastomeric dampening link including two or more interconnected dampening bushings mounted around corresponding ones of the two or more adjustable length turnbuckles, and the elastomeric dampening link including at least one bar connecting adjacent ones of the dampening bushings.

2. The assembly as claimed in claim 1 further comprising a clamp with a clamping band clamped around each of the dampening bushings.

3. The assembly as claimed in claim 2 further comprising the bar in tension between the dampening bushings.

4. The assembly as claimed in claim 2 further comprising at least one of the dampening bushings circumscribed about a bushing centerline, being substantially solid, and having a rectangular slot extending radially inwardly from an annular surface of each of the dampening bushings.

5. An assembly as claimed in claim 1 further comprising:

each of the turnbuckles including a rod disposed in a corresponding one of the dampening bushings and having distal hollow internally threaded first end, a first eyelet mounted on a first externally threaded shank, and the first externally threaded shank adjustably screwed into the internally threaded first end.

6. The assembly as claimed in claim 5 further comprising the bar in tension between the dampening bushings.

7. The assembly as claimed in claim 6 further comprising clamps with clamping bands clamped around the dampening bushings.

8. The assembly as claimed in claim 5 further comprising:

at least one of the dampening bushings circumscribed about a bushing centerline, being substantially solid, and having a rectangular slot extending radially inwardly from an annular surface of each of the dampening bushings, the rod including a six sided surface with two opposite sides slidingly engaging and fitting snugly in the slot, and clamps with clamping bands clamped around the dampening bushings.

9. The assembly as claimed in claim 8 further comprising the clamping band received in an annular slot or groove in each of the dampening bushings.

10. A variable stator vane actuation apparatus comprising:

a compressor casing surrounding and supporting two or more rows of variable stator vanes, a variable stator vane dampened linkage including two or more unison ring assemblies mounted exterior to the compressor casing and operable for varying the angle of variable stator vanes in corresponding ones of the rows, two or more adjustable length turnbuckles linking corresponding ones of the two or more unison ring assemblies to a torque shaft mounted on the compressor casing, an elastomeric dampening link including two or more interconnected dampening bushings mounted around corresponding ones of the two or more adjustable length turnbuckles, and the elastomeric dampening link including at least one bar connecting adjacent ones of the dampening bushings.

11. The apparatus as claimed in claim 10 further comprising the bar in tension between the dampening bushings.

12. The apparatus as claimed in claim 11 further comprising a clamp with a clamping band clamped around each of the dampening bushings.

13. The apparatus as claimed in claim 12 further comprising at least one of the dampening bushings circumscribed about a bushing centerline, being substantially solid, and having a rectangular slot extending radially inwardly from an annular surface of each of the dampening bushings.

14. The apparatus as claimed in claim 10 further comprising:

each of the turnbuckles including a rod disposed in a corresponding one of the dampening bushings and having distal hollow internally threaded first and second ends, first and second eyelets attached to or mounted on first and second externally threaded shanks respectively, and the first and second externally threaded shanks adjustably screwed into the internally threaded first and second ends respectively.

15. The apparatus as claimed in claim 14 further comprising:

the first eyelets pivotably connected to first clevises mounted on the torque shaft with first clevis ball joints, the second eyelets pivotably connected to second clevises mounted to unison rings of the two or more unison ring assemblies with second clevis ball joints, and first and second spherical bushings centered and disposed in the first and second eyelets respectively.

16. The apparatus as claimed in claim 15 further comprising the bar in tension between the dampening bushings.

17. The apparatus as claimed in claim 16 further comprising a clamp with a clamping band clamped around each of the dampening bushings.

18. The apparatus as claimed in claim 17 further comprising the clamping band received in an annular slot or groove in each of the dampening bushings.

19. The apparatus as claimed in claim 18 further comprising:

at least one of the dampening bushings circumscribed about a bushing centerline, being substantially solid, and having a rectangular slot extending radially inwardly from an annular surface of each of the dampening bushings, the rod including a six sided surface with two opposite sides slidingly engaging and fitting snugly in the slot, and a clamp with a clamping band clamped around each of the dampening bushings.

20. The apparatus as claimed in claim 11 further comprising:

vane crank arms connecting the variable stator vanes to the unison rings, the second clevises mounted on bridges of the unison rings, each of the turnbuckles including a rod disposed in a corresponding one of the dampening bushings and having distal hollow internally threaded first and second ends, first and second eyelets attached to or mounted on first and second externally threaded shanks respectively, the first and second externally threaded shanks adjustably screwed into the internally threaded first and second ends respectively, the first eyelets pivotably connected to first clevises mounted on the torque shaft with first clevis ball joints, the second eyelets pivotably connected to second clevises mounted to unison rings of the two or more unison ring assemblies with second clevis ball joints, and first and second spherical bushings centered and disposed in the first and second eyelets respectively.

* * * * *